US007965971B2

(12) United States Patent
Thayer et al.

(10) Patent No.: US 7,965,971 B2
(45) Date of Patent: Jun. 21, 2011

(54) BLADES, PRINTING APPARATUSES, REPLACEABLE CARTRIDGES AND METHODS OF TREATING SUBSTANCES ON SURFACES

(75) Inventors: Bruce E. Thayer, Webster, NY (US); Richard W. Seyfried, Williamson, NY (US); Cheryl A. Linton, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 450 days.

(21) Appl. No.: 12/180,796

(22) Filed: Jul. 28, 2008

(65) Prior Publication Data

US 2010/0021198 A1 Jan. 28, 2010

(51) Int. Cl.
*G03G 21/00* (2006.01)

(52) U.S. Cl. ..... 399/350; 399/123

(58) Field of Classification Search ..... 399/111, 399/123, 350, 351

See application file for complete search history.

(56) References Cited

U.S. PATENT DOCUMENTS

| | | | | |
|---|---|---|---|---|
| 5,347,353 | A | 9/1994 | Fletcher | |
| 5,596,396 | A * | 1/1997 | Landa et al. | 399/237 |
| 5,826,132 | A | 10/1998 | Damji et al. | |
| 6,463,248 | B1 | 10/2002 | Jia et al. | |
| 6,494,570 | B1 | 12/2002 | Snyder | |
| 6,983,120 | B2 | 1/2006 | Ishii et al. | |
| 7,092,655 | B2 * | 8/2006 | Noda et al. | 399/90 |
| 7,242,885 | B2 | 7/2007 | Abe et al. | |
| 7,242,894 | B2 | 7/2007 | Kuo et al. | |
| 7,376,378 | B2 | 5/2008 | Van Bortel | |
| 2007/0146416 | A1 * | 6/2007 | Nakashima | 347/33 |

FOREIGN PATENT DOCUMENTS

| | | | |
|---|---|---|---|
| JP | 05127509 A | * | 5/1993 |
| JP | 08292690 A | * | 11/1996 |

OTHER PUBLICATIONS

Machine translation of JP 05127509.*
Machine translation of JP 08292690.*
Warren C. Young; "Roark's Formulas for Stress and Strain"; Sixth Edition; McGraw-Hill Book Company, p. 162 (1989).
HOODANDCO.COM; Properties of ASTM B388 Type Materials.

* cited by examiner

*Primary Examiner* — David M Gray
*Assistant Examiner* — Barnabas T Fekete
(74) *Attorney, Agent, or Firm* — Ronald E. Prass, Jr.; Prass LLP

(57) ABSTRACT

Blades, printing apparatuses, replaceable cartridges and methods of treating substances on surfaces are disclosed. An embodiment of a blade for treating a substance on a surface of a component includes a body having a free end portion with a surface, and which is comprised of an elastomeric material. A bi-material spring is adapted to apply a load to the body such that the surface of the body treats the substance on the surface of the component.

19 Claims, 13 Drawing Sheets

BLADES, PRINTING APPARATUSES, REPLACEABLE CARTRIDGES AND METHODS OF TREATING SUBSTANCES ON SURFACES

BACKGROUND

Disclosed herein are blades, printing apparatuses, replaceable cartridges and methods of treating substances on surfaces.

Printing apparatuses, such as xerographic and ink jet apparatuses, can include members for cleaning substances from surfaces, or metering substances on surfaces. Such members can be subjected to changing environmental conditions that affect their performance in the apparatuses.

It would be desirable to provide members for treating substances on surfaces in apparatuses under different environmental conditions.

SUMMARY

According to aspects of the embodiments, blades, printing apparatuses, replaceable cartridges and methods of treating substances on surfaces, are provided.

An exemplary embodiment of a blade for treating a substance on a surface of a component comprises a body including a free end portion having a first surface, the body being comprised of an elastomeric material; and a bi-material spring adapted to apply a load to the body such that the first surface of the body treats the substance on the surface of the component.

DRAWINGS

DETAILED DESCRIPTION

Aspects of the embodiments disclosed herein relate to blades, printing apparatuses, replaceable cartridges, and methods of treating substances on surfaces.

The disclosed embodiments include a blade for treating a substance on a surface of a component. The blade comprises a body including a free end portion having a first surface, the body being comprised of an elastomeric material; and a bi-material spring adapted to apply a load to the body such that the first surface of the body treats the substance on the surface of the component.

The disclosed embodiments further include an interference-loaded blade for cleaning a surface of a component in a printing apparatus. The blade comprises a bi-material spring including a fixed first end and a free second end opposite to the first end, and a body secured to the bi-material spring and comprised of an elastomeric material. The bi-material spring is adapted to apply a load to the body such that the body contacts and cleans the surface of the component.

The disclosed embodiments further include a replaceable cartridge for a printing apparatus, comprising a chamber for containing developer material including toner; a photoreceptor having a surface on which toner images are formed; and a blade for cleaning toner on the surface of the photoreceptor. The blade comprises a body comprising a free end portion including a surface, the body being comprised of an elastomeric material; and a bi-material spring adapted to apply a load to the body such that the surface of the body cleans the toner on the surface of the photoreceptor.

The disclosed embodiments further include a method of treating a substance on a surface of a component in a printing apparatus with a blade comprising a body comprised of an elastomeric material, and a bi-material spring. The method comprises applying a load to the body with the bi-material spring, and contacting the substance on the surface of the component with the body.

Apparatuses can include blades for cleaning surfaces, or for metering substances on surfaces, of components of the apparatuses. Such apparatuses include printing apparatuses, such as xerographic apparatuses and ink jet printing apparatuses.

Figure 1:
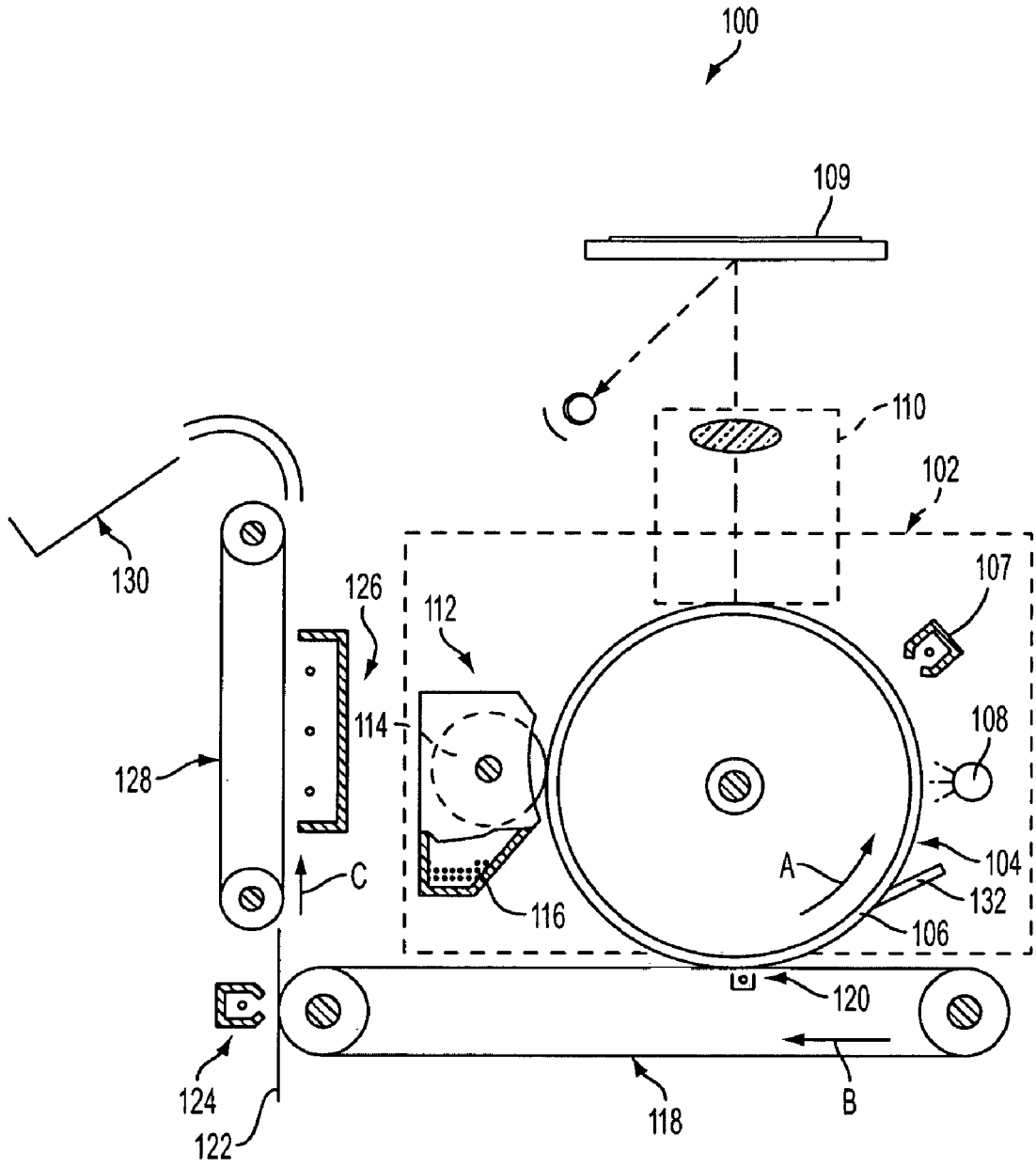
FIG. 1 illustrates an embodiment of a printing apparatus.
Figure 2:
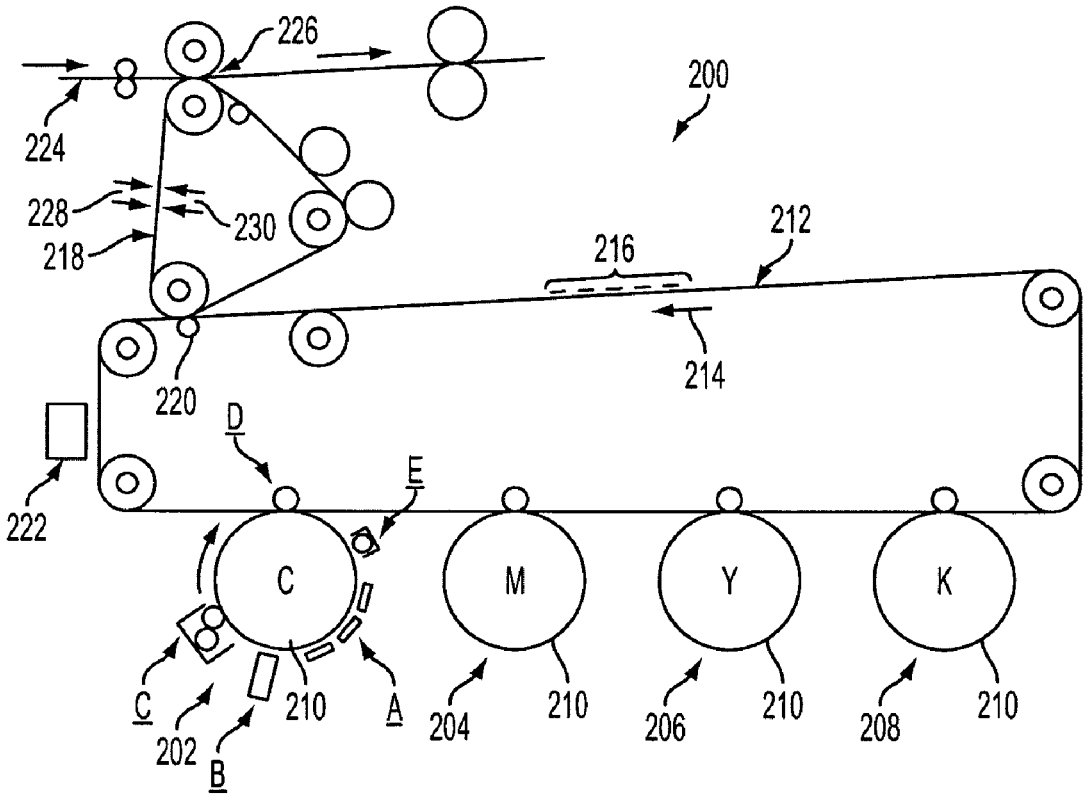
FIG. 2 illustrates another embodiment of a printing apparatus.
Figure 3:
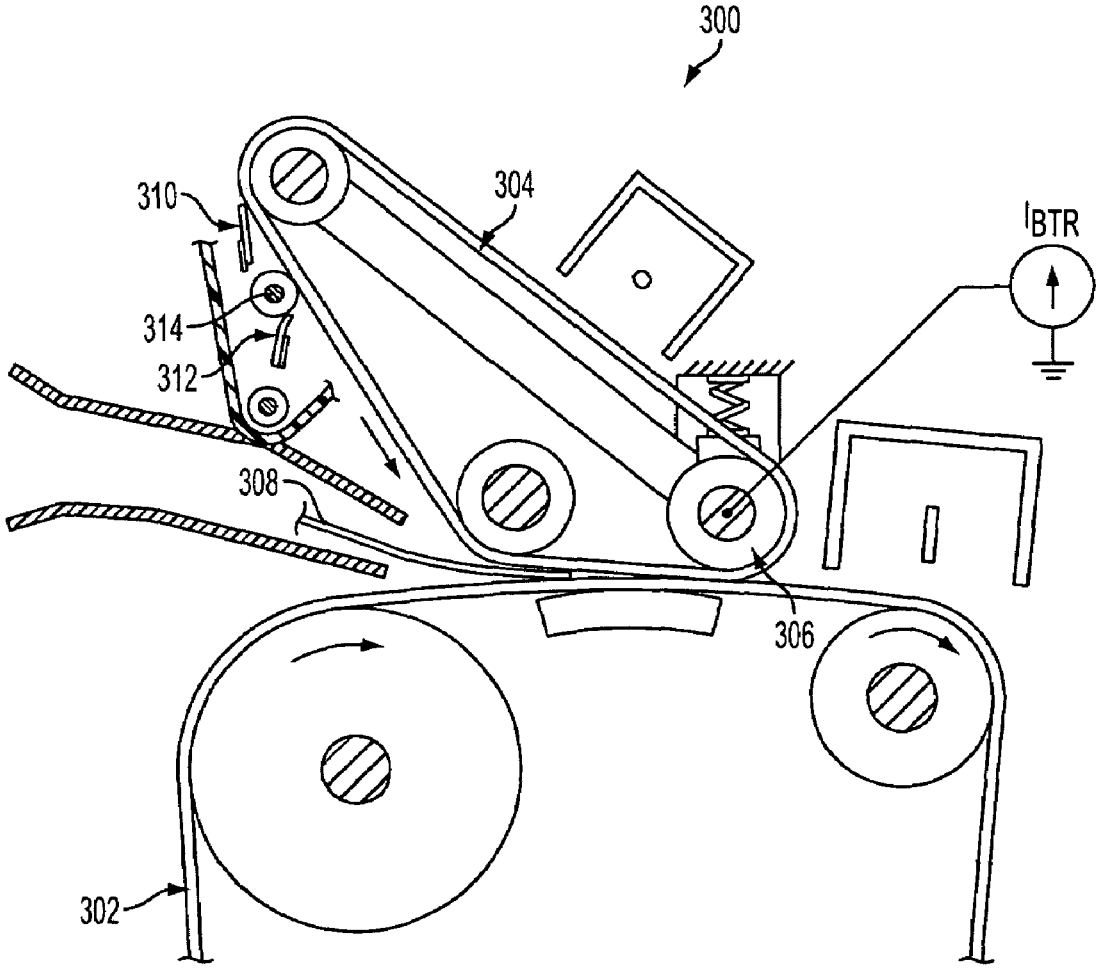
FIG. 3 illustrates another embodiment of a printing apparatus.

FIGS. 1 to 3 illustrate exemplary printing apparatuses that include cleaning blades for cleaning surfaces of the apparatuses. FIG. 1 shows an embodiment of a printing apparatus 100, such as disclosed in U.S. Pat. No. 5,347,353, which is incorporated herein by reference in its entirety. The printing apparatus 100 includes an image forming device 102. A drum 104 with an outer photoconductive layer 106 is rotated counter-clockwise, as indicated by arrow A. A lamp 108 is arranged to discharge residual charge on the photoconductive layer 106 prior to an imaging cycle. A charging station 107 deposits a substantially uniform electric charge onto the outer surface of the outer photoconductive layer 106. During the imaging cycle, a light image of a document 109 is projected onto the photoconductive layer 106 at an exposure station 110, image-wise discharging the electric charge on the outer surface of the photoconductive layer 106, to form a latent electrostatic image on the photoconductive layer 106. The drum 104 rotates this image to a development station 112 including a developer roll 114 and a developer material 116. The developer material 116 includes toner, which is brought into contact with the photoconductive layer 106 and attracted to the latent electrostatic image, producing a toner image on the photoconductive layer 106.

The toner image on the photoconductive layer 106 is transferred to an intermediate transfer belt 118 at a transfer station 120. The intermediate transfer belt 118 is rotated clockwise, as indicated by arrow B. The toner image on the intermediate transfer belt 118 is transferred to a medium 122, e.g., paper, at a transfer station 124. The medium 122 is then advanced in the direction indicated by arrow C to a fusing station 126. At the fusing station 126, the toner image is fused on the medium 122. A conveyor belt 128 conveys the medium 122 with the fused image to a catch tray 130.

As shown in FIG. 1, a flexible, resilient blade 132 is positioned to remove residual developer material adhering to the outer surface of the photoconductive layer 106 before the next imaging cycle.

FIG. 2 shows an embodiment of a printing apparatus 200, such as disclosed in U.S. Pat. No. 6,463,248, which is incorporated herein by reference in its entirety. The printing apparatus 200 includes xerographic imaging stations 202, 204, 206 and 208, arranged in series and each including a photoreceptor drum 210. As shown only for imaging station 202 for simplicity, the photoreceptor drum 210 is rotated sequentially through a charging station A, exposure station B, development station C, image transfer station D, and cleaning station E. A cyan (C) toner image is transferred to an intermediate transfer belt 212. The intermediate transfer belt 212 is advanced in the direction of arrow 214, and magenta (M), yellow (Y) and black (K) toner images are sequentially transferred to the intermediate transfer belt 212 at imaging stations 204, 206 and 208, respectively, to form composite color toner images 216 on the intermediate transfer belt 212.

The toner images 216 are transferred to a transfuse belt 218 using a biased transfer roll 220. A cleaning member 222, such as a cleaning blade, removes residual toner particles from the intermediate transfer belt 212 after transfer of the toner images 216. The transfuse belt 218 transfers and fuses the toner images to a medium 224, e.g., paper, at a nip 226. The transfuse belt 218 can be heated externally, as indicated by arrows 228, or internally, as indicated by arrows 230.

FIG. 3 shows an embodiment of a printing apparatus 300, such as disclosed in U.S. Pat. No. 7,242,894, which is incorporated herein by reference in its entirety. The printing apparatus 300 includes a photoreceptor belt 302, transfer belt 304, and electrically-biased transfer roll 306. Toner images are formed on the photoreceptor belt 302. A medium 308 is passed to a nip between the transfer belt 304 and the photoreceptor belt 302, where a toner image is transferred from the photoreceptor belt 302 to the medium 308.

As shown in FIG. 3, a cleaning blade 310 removes residual toner particles from the transfer belt 304. A cleaning blade 312 removes residual toner particles from an electrically-biased cleaning roll 314.

In printing apparatuses, cleaning blades can also be used in fusers to meter liquid substances, such as disclosed in U.S. Pat. No. 7,376,378. which is incorporated herein by reference in its entirety, or to clean surfaces.

Figure 4:
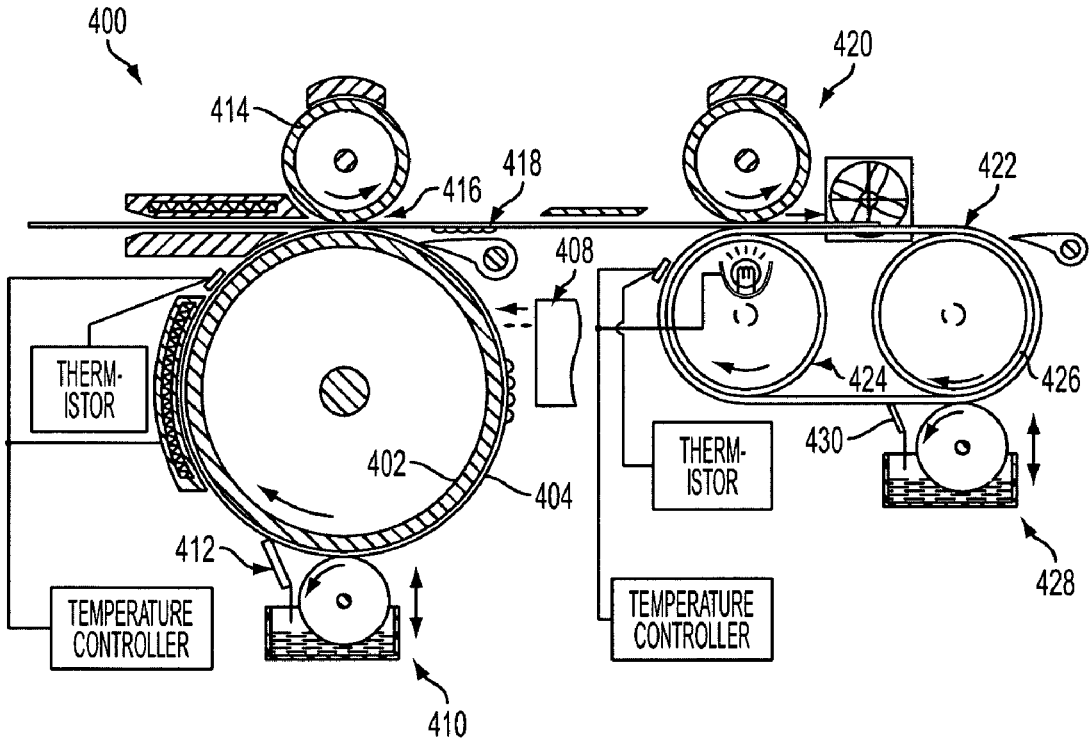
FIG. 4 illustrates an embodiment of a solid ink jet printer.

FIG. 4 illustrates an embodiment of an ink jet-based printing apparatus 400, such as disclosed in U.S. Pat. No. 6,494,570, which is incorporated herein by reference in its entirety. The apparatus 400 includes a drum 402 with an overlying intermediate transfer surface 404. The drum 402 rotates clockwise. An ink jet print head 408 is positioned to deposit ink droplets on the intermediate transfer surface 404. A solid ink can be used. An applicator assembly 410 applies a release liquid, such as oil, to the intermediate transfer surface 404. A metering blade 412 meters the release liquid on the intermediate transfer surface 404.

The apparatus 400 further includes a transfer roller 414. The transfer roller 414 and the intermediate transfer surface 404 define a nip 416 at which an ink image is transferred to a medium 418, e.g., paper.

The apparatus 400 further includes a fuser 420. A continuous belt 422 is supported on a fuser roller 424 and belt roller 426. An applicator assembly 428 applies a release liquid, such as oil, to the belt 422. A metering blade 430 meters the release liquid on the belt 422.

Figure 5:
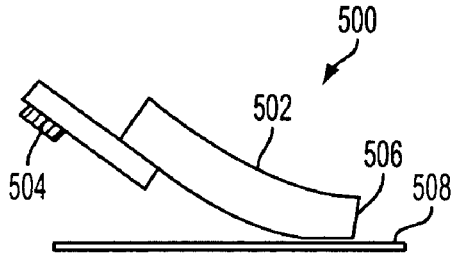
FIG. 5 illustrates an interference-loaded blade without temperature compensating features.

FIG. 5 illustrates an interference-loaded blade 500. The blade 500 can be used for cleaning surfaces in the apparatuses 100, 200, 300 and 400, for example. The blade 500 comprises a body 502 including one end attached to a fixed support 504, and a free end having a tip 506 in contact with a surface 508 cleaned by the blade 500. Deflection of the blade 500 due to interference with the surface 508 creates the blade force applied to the tip 506. The surface 508 can be, for example, a surface of a moving roll or belt in a printing apparatus. Toner, for example, may be cleaned on the surface 508.

In printing apparatuses, such as the apparatuses 100, 200, 300 and 400, the cleaning blade 500 can be subjected to significant temperature changes and temperatures ranging from cold to hot. These temperature changes include changes in the ambient temperature, as well as changes in temperature of components that the blades are operatively associated with. The blade 500 does not include temperature-compensating features. The difficulty of cleaning a surface using the blade 500 can be influenced by environmental changes. In some apparatuses, temperature has minimal impact, or no impact, on the cleaning load of the blade. As used herein, the "cleaning load" is the minimum blade load that can be applied to produce adequate cleaning of a surface by removing a dry and/or a liquid substance from the surface. However, in other apparatuses, these temperature changes affect the properties of the blade, making cleaning a surface with the blade most difficult at temperature extremes in the apparatus. That is, the cleaning load is highest at such temperature extremes.

In printing apparatuses, factors that can affect the impact of temperature on the blade cleaning load include, e.g., development systems, toners, cleaning surfaces (e.g., roughness and composition) and blade composition. Change in the cleaning load with temperature changes can be quantified by testing. Typically, such testing is done in at least the following three zones having different ambient temperature and humidity conditions: zone (A): 80° F./80% relative humidity; zone B: 70° F./50% relative humidity; zone (C): 60° F./20% relative humidity.

In some systems, the blade 500 can experience a cleaning stress at cold temperatures or at hot temperatures. A "cleaning stress" is a stress experienced by the blade in an environment that makes it more difficult to clean a surface with the blade in that environment. When a blade experiences a "cleaning stress" at a cold temperature environment, the highest cleaning load is at that environment. When a blade experiences a cleaning stress at a hot temperature environment, the highest cleaning load is at that environment.

The body 502 of the blade 500 can typically be made of an elastomeric material. At cold temperatures, elastomeric materials may have inadequate elastic rebound properties, causing the blade 500 to apply an inconsistent load against the surface 508. Also, some substances, such as toners, can adhere more strongly to, and consequently be more difficult to remove from, the surface 508 at cold temperatures than at hot temperatures using the blade 500. However, some other substances, such as some other toners, are more difficult to clean from the surface 508 at high temperatures than at low temperatures. For these other substances, a cleaning stress occurs at the high temperatures.

The stiffness of the elastomeric material can be characterized by its elastic modulus. The modulus of the elastomeric material of the blade 500 decreases with increasing temperature, resulting in the blade 500 becoming softer. Because it is desirable that the blade 500 be able to provide adequate cleaning under all environmental conditions, including temperatures, that it is expected to be exposed to, a blade load can be selected for the environment at which the cleaning stress occurs and the cleaning load is highest. However, with this approach, the blade load will be higher than needed for adequate cleaning (i.e., above the cleaning load) at other environmental conditions where cleaning is easier.

In systems where there is a cleaning stress at cold temperatures, the interference-loaded blade 500 shown in FIG. 5 typically applies only a minimal excess blade load over the expected temperature range.

In systems where there is a cleaning stress at high temperatures, the applied load by the blade is lower at such high temperatures because of the reduction in the blade modulus. The blade can be designed to apply a sufficiently-high load to clean adequately at such high temperatures (i.e., a load equal to at least the cleaning load) despite the reduction in the blade modulus. However, in such high-temperature-stress systems, cleaning is easier at nominal and low temperatures, at which a lower blade load is sufficient. Because the blade load increases with decreasing temperature due to the increase in blade modulus, when the interference-loaded blade 500 shown in FIG. 5 is designed for high-temperature use, it will operate at higher applied blade loads under nominal temperature conditions, and at even higher applied blade loads at low temperature conditions, than for high temperatures. As such, the blade will be overloaded at nominal temperatures, and significantly overloaded at cold temperatures, relative to lower cleaning loads that would provide adequate cleaning at these temperatures. As a result of applying such higher blade loads at nominal and low temperatures, in such systems the blades can experience significantly-higher wear rates, and correspondingly shorter lives, than they would otherwise experience if they applied loads that are lower, but sufficiently-high to perform the cleaning function, at such nominal and low temperatures (i.e., loads equal to about the cleaning load at these temperatures).

In systems where there is minimal or no blade cleaning stress with environment, the interference-loaded blade 500 shown in FIG. 5 will experience a load that is higher than the cleaning load at nominal and cold environments.

To further exemplify the behavior of the interference-loaded blade 500 shown in FIG. 5 in different environments in a printing apparatus, TABLE 1 shows exemplary blade loading conditions as a function of the environment and stress conditions in the apparatus. The following values are assumed for the cleaning load of the blade: easiest cleaning: 27 g/cm, nominal cleaning: 30 g/cm, and hardest cleaning: 33 g/cm.

TABLE I

| Location of | Apparatus Environment | | |
|---|---|---|---|
| Cleaning Stress | Cold Zone (C) | Nominal Zone (B) | Hot Zone (A) |
| None | Cleaning: Nominal<br>Blade Load: Highest<br>Applied Load: 35 g/cm<br>Cleaning Load: 30 g/cm<br>Excess Load: 5 g/cm | Cleaning: Nominal<br>Blade Load: Nominal<br>Applied Load: 32 g/cm<br>Cleaning Load: 30 g/cm<br>Excess Load: 2 g/cm | Cleaning: Nominal<br>Blade Load: Lowest<br>Applied Load: 30 g/cm<br>Cleaning Load: 30 g/cm<br>Excess Load: 0 g/cm |
| Cold Zone | Cleaning: Hardest<br>Blade Load: Highest<br>Applied Load: 33 g/cm<br>Cleaning Load: 33 g/cm<br>Excess Load: 0 g/cm | Cleaning: Nominal<br>Blade Load: Nominal<br>Applied Load: 30 g/cm<br>Cleaning Load: 30 g/cm<br>Excess Load: 0 g/cm | Cleaning: Easiest<br>Blade Load: Lowest<br>Applied Load: 28 g/cm<br>Cleaning Load: 27 g/cm<br>Excess Load: 1 g/cm |
| Hot Zone | Cleaning: Easiest<br>Blade Load: Highest<br>Applied Load: 38 g/cm<br>Cleaning Load: 27 g/cm<br>Excess load: 11 g/cm | Cleaning: Nominal<br>Blade Load: Nominal<br>Applied Load: 35 g/cm<br>Cleaning Load: 30 g/cm<br>Excess load: 5 g/cm | Cleaning: Hardest<br>Blade Load: Lowest<br>Applied Load: 33 g/cm<br>Cleaning Load: 33 g/cm<br>Excess load: 0 g/cm |

As shown in TABLE 1, the blade can experience a cleaning stress at a cold zone or a hot zone in the apparatus, or the blade can experience no cleaning stress. When the blade experiences a cleaning stress at a cold zone or hot zone (i.e., the cleaning load is highest and cleaning is most difficult in this zone), the cleaning load is 33 g/cm in these zones, and lower (i.e., either 30 g/cm or 27 g/cm) for the other two zones of the apparatus where cleaning is easier.

The cold zone increases the blade load, the nominal zone does not affect the blade load, and the hot zone decreases the blade load. In TABLE 1, the following values are assumed for the effect of the environment on the blade load due to changes in modulus of the blade material: nominal environment (nominal zone): 0 g/cm; cold environment (cold zone): +3 g/cm; and hot environment (hot zone): −2 g/cm. In Table 1, for each of the cleaning stress locations, for the blade without temperature-compensating features, the values of the applied load for the cold zone (C), nominal zone (B) and hot zone (A), respectively, differ due to the effect of the environment on the blade load due to the change in blade modulus. The applied load for cold zone (C) is 3 g/cm higher, and the applied load for hot zone (A) is 2 g/cm lower, than the applied load for nominal zone (B).

As shown in TABLE 1, when there is no zone with a cleaning stress, the difficulty of cleaning with the blade is the same for each zone. For this case, the blade can be constructed to apply the cleaning load at the highest temperatures. However, because the blade modulus increases with decreasing temperature, the applied load of the blade is lowest in hot zone (A), nominal in nominal zone (B), and highest in cold zone (C). While the applied load equals the cleaning load for hot zone (A) (i.e., the excess load is zero), at nominal zone (B), the excess load is 2 g/cm, and at cold zone (C), the excess load is 5 g/cm. Blade life typically decreases by about 1.5% for each g/cm increase in blade load. For the case of no cleaning stress zone, the blade can experience a decrease in blade life of about 8% if used entirely in cold zone (C).

Figure 6:
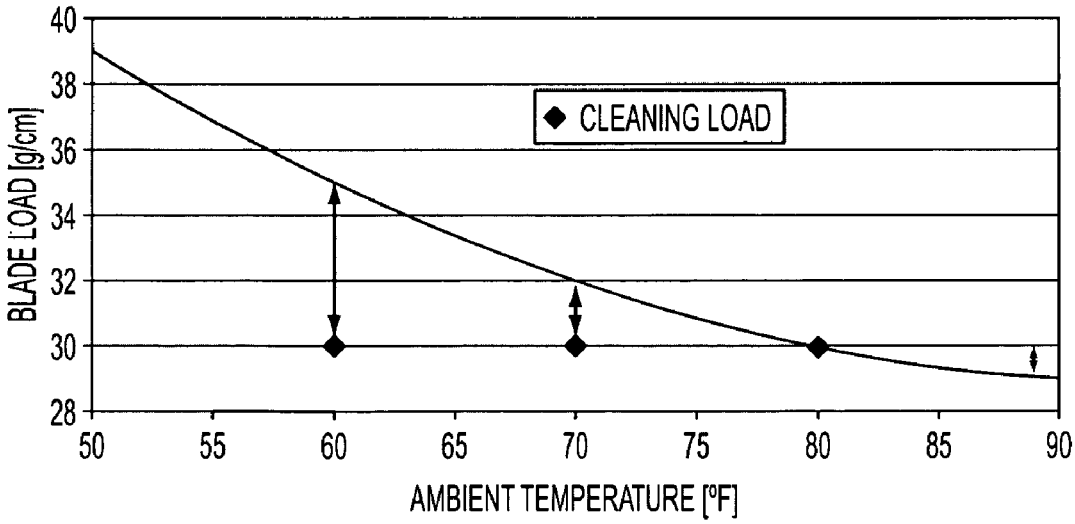
FIG. 6 illustrates an applied blade load versus ambient temperature curve for an interference-loaded blade without temperature-compensating features, where the stress blade cleaning load is independent of the ambient temperature.

FIG. 6 shows an exemplary applied blade load versus ambient temperature curve for the interference-loaded blade with no cleaning stress zone. As shown, the cleaning load has the same value of 30 g/cm at 60° F. (cold zone (C)), 70° F. (nominal zone (B)), and 80° F. (hot zone (A)). The applied load decreases with increasing temperature. At lower temperatures, the applied load is significantly higher than the cleaning load. For example, at 60° F., the applied load exceeds the cleaning load by 5 g/cm. At temperatures above about 80° F., the applied load may be too low to provide adequate cleaning.

As further shown in TABLE 1, when the cleaning stress occurs in the cold zone, cleaning is hardest at the cold zone (C), nominal at nominal zone (B) and easiest at hot zone (A). For cold zone (C) and nominal zone (B), the excess load is zero. For hot zone (A), the excess load is 1 g/cm.

Figure 7:
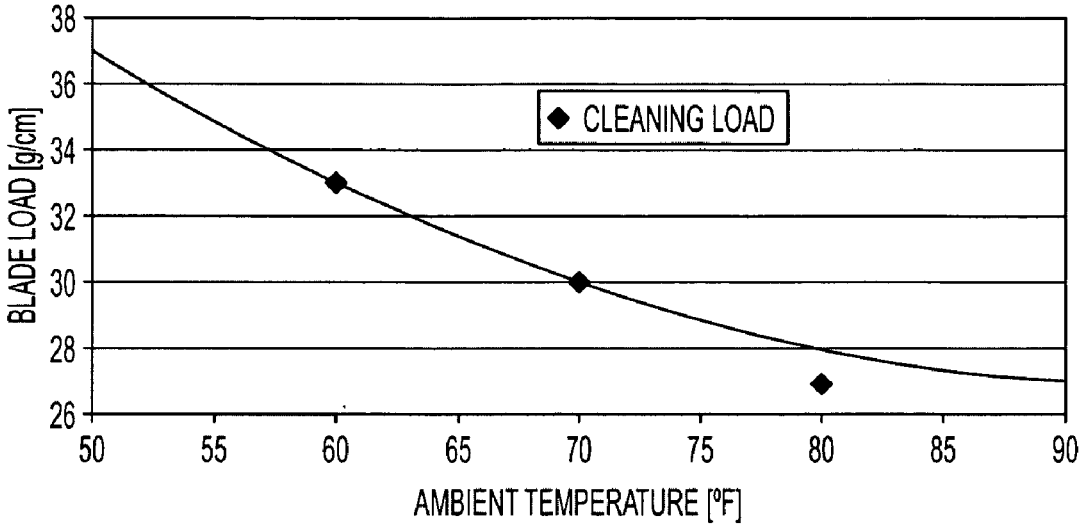
FIG. 7 illustrates an applied blade load versus ambient temperature curve for an interference-loaded blade without temperature-compensating features, where the stress blade cleaning load is at a cold zone in an apparatus.

FIG. 7 shows an exemplary applied blade load versus ambient temperature curve for the interference-loaded blade shown in FIG. 5 where the cleaning stress is at the cold zone. For this case, the cleaning load and the applied load both decrease with temperature. The cleaning load equals the applied load at 60° F. (cold zone (C)) and 70° F. (nominal zone (B)). The applied load slightly exceeds the cleaning load at 80° F. (hot zone (A)) and higher temperatures. As such, the blade may experience a slight decrease in blade life if used entirely in hot zone (A).

As further shown in TABLE 1, when the cleaning stress is at the hot zone, cleaning is hardest in hot zone (A), nominal in nominal zone (B), and easiest in cold zone (C). The blade modulus increases with decreasing temperature, and the applied load is lowest at hot zone (A), nominal at nominal zone (B), and highest at cold zone (C). The excess load is zero for hot zone (A), but is 5 g/cm for nominal zone (B) and 11 g/cm for cold zone (C). At these excess loads, the blade can experience a decrease in blade life of about 8% if used entirely in nominal zone (B), and about 15% if used entirely in cold zone (C).

Figure 8:
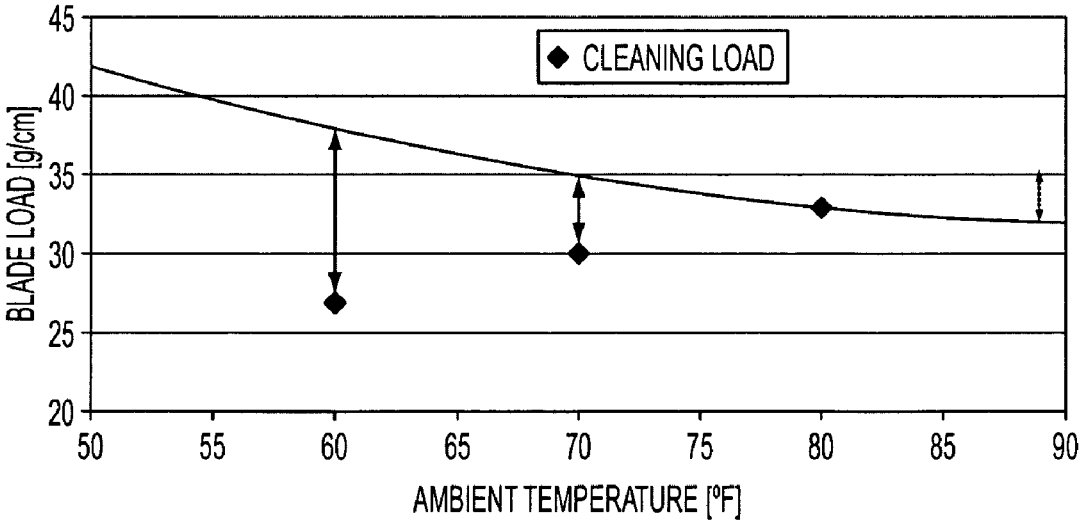
FIG. 8 illustrates an applied blade load versus ambient temperature curve for an interference-loaded blade without temperature-compensating features, where the stress blade cleaning load is at a hot zone in an apparatus.

FIG. 8 shows an exemplary applied blade load versus ambient temperature curve for the interference-loaded blade shown in FIG. 5 where the cleaning stress is at the hot zone. The cleaning load decreases with decreasing temperature. At temperatures below about 80° F., the applied load exceeds the cleaning load, with the magnitude of this difference increasing with decreasing temperature. Because the cleaning load decreases, while the applied load increases with decreasing temperature, at low temperatures the blade is loaded excessively. At very high temperatures, e.g., above 80° F., the applied load may be too low to provide adequate cleaning.

In light of these inefficiencies in blade loading characteristics of the interference-loaded blade 500 shown in FIG. 5, for example, blades are provided that include features for more-efficient blade loading at low, nominal and hot temperatures. Exemplary embodiments of the blades are shown in FIGS. 9 to 14. In embodiments, the blades include a bi-material spring for applying a force component to the blade, or to a blade support. The bi-material spring adjusts the blade load to compensate for temperature variations, either by increasing or decreasing blade interference with a surface. By taking into account how the modulus of the blade material changes with temperature, and also how the blade cleaning load changes as a function of environment, embodiments of the blades including a bi-material spring can be constructed to apply the desired load to treat substances on surfaces. This treating can change the amount of a substance on a surface by either removing the substance from, or changing the level of the substance on, the surface, or the treating can distribute a substance on the surface. The treating can include, e.g., cleaning the surface to remove a dry or liquid substance from the surface, and/or metering such a dry or liquid substance on the surface to a desired level.

In embodiments, the blades including a bi-material spring can minimize the difference between the applied load and the cleaning load of the blade for cleaning surfaces over the normal temperature range of the blade. By constructing the blades to avoid applying loads higher than the cleaning load to surfaces, the blades can provide longer lives than that of the blade 500 shown in FIG. 5, for example, without temperature-compensating features.

Embodiments of the blades can be used in various types of apparatuses to clean substances from surfaces, or to meter substances on surfaces. In xerographic apparatuses, for example, the blades can be used to clean developer material from surfaces of rolls or belts. Such rolls and belts can include, e.g., photoreceptor rolls, photoreceptor belts, intermediate transfer belts, bias transfer belts, bias transfer rolls, electrostatic detoning rolls, and bias charging rolls. The xerographic apparatuses can include one or more of such components. One or more blades including a bi-material spring can be used to treat substances on such components in the apparatuses.

Embodiments of the blades can also be used to meter dry or liquid substances on surfaces, such as rolls or belts, in printing apparatuses.

Embodiments of the blades can also be used in solid ink jet printers to meter different liquids, such as oils, on surfaces.

In embodiments, surfaces that are cleaned, or that support a substance to be metered, by the blade, can be movable relative to the blade by either translation or rotation. Alternatively, the surfaces can be fixed and the blade movable, or both the blade and surface can be movable.

Figure 10:
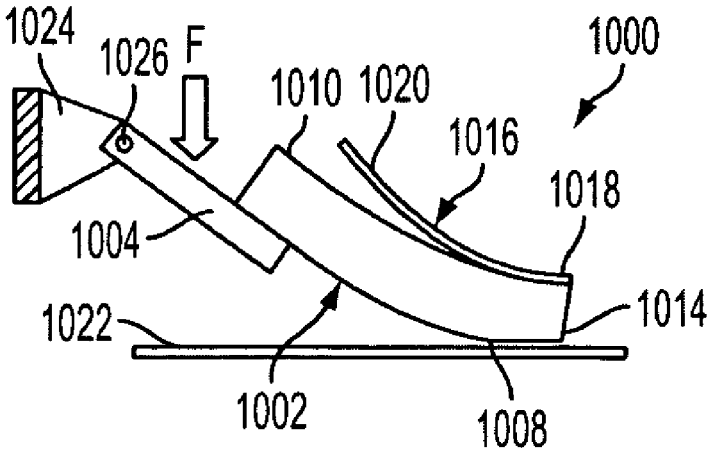
FIG. 10 illustrates another exemplary embodiment of a force-loaded blade including a bi-material spring.
Figure 11:
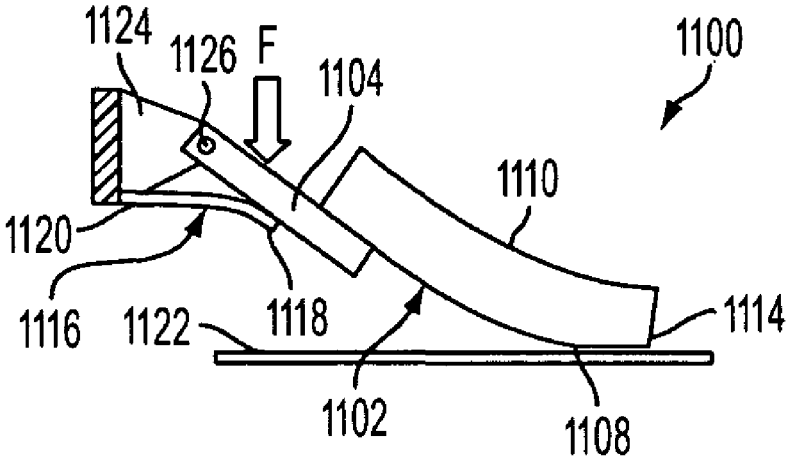
FIG. 11 illustrates another exemplary embodiment of a force-loaded blade including a bi-material spring.

In some embodiments, the blade is constructed such that the bi-material spring applies a force to the blade in addition to an interference load, or to a force load applied by a force-applying member. Exemplary embodiments of such blades are shown in FIGS. 9 to 11.

Figure 9:
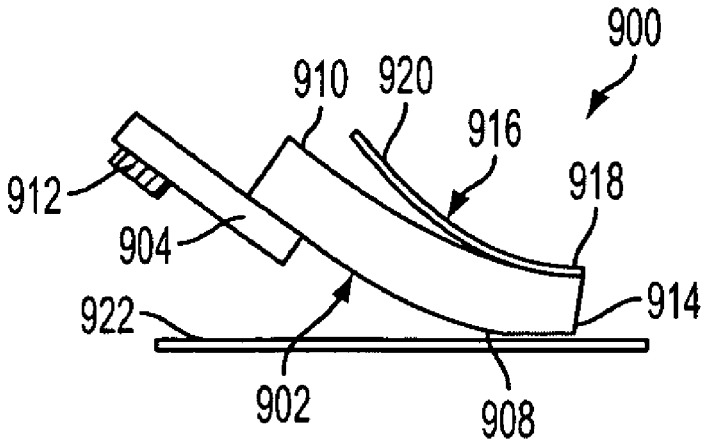
FIG. 9 illustrates an exemplary embodiment of an interference-loaded blade including a bi-material spring for temperature compensation.

FIG. 9 illustrates an exemplary embodiment of an interference-loaded blade 900 including a bi-material spring 916 for adjusting the blade load to compensate for temperature variations that the blade 900 is exposed to. These temperature-compensating features allow the blade 900 to be used in environments to clean a surface of a component, or meter a substance on a surface, at low, nominal and high environmental temperatures without experiencing a high wear rate to achieve this cleaning.

The blade 900 includes a body 902. The body 902 is comprised of any suitable elastomeric material, such as a urethane, a fluoroelastomer sold under the trademark Viton® by DuPont Performance Elastomers, L.L.C., or the like. The body 902 is attached to a blade holder 904. In this embodiment, the body 902 is bonded to the blade holder 902. In other embodiments, a clamping or friction mount can be used to attach the body 902 to the blade holder 904. The blade holder 904 is comprised of any suitable material, such as steel, aluminum, or other rigid material. The body 902 includes a first surface 908 and an opposite second surface 910. Typically, the blade 900 is used in an orientation in which the first surface 908 is the bottom surface, and the second surface 910 is the top surface, of the blade 900. In this embodiment, the blade holder 904 is fixedly connected to a fixed support 912. The body 902 includes a free end portion with a tip 914. The blade 900 has a cantilever configuration.

As shown in FIG. 9, the bi-material spring 916 is a leaf spring including a free end 918 pressing against the second surface 910 at the free end portion of the body 902, and also a portion including a fixed end 920 secured to a fixed support, e.g., the fixed support 912 or rigid blade holder 904 (not shown). The bi-material spring 916 converts a temperature change into a mechanical displacement, which results in a load being applied to the blade 900.

The bi-material spring 916 has a composite structure including two strips of two different materials that have different coefficients of thermal expansion (CTE) from each other. Embodiments of the bi-material spring 916 change shape in a predictable manner as a function of temperature. The materials of the bi-material spring can be selected to match the coefficients of thermal expansion of the two materials so as to provide the desired range of motion of the spring over a given temperature range to which the blade is exposed. The materials can be the same or different types of materials, such as combinations of metals and/or polymers. In exemplary embodiments, the two different materials of the bi-material springs can be selected from the following combinations: metal/metal (bimetallic springs), metal/polymer, or polymer/polymer. The metals can be pure metals or metal alloys. Metals and metal alloys can have a CTE in the range of about $2\times10^{-6}$ in./in./° C. (e.g., low expansion nickel alloys) to about $20\times10^{-6}$ in./in./° C. (e.g., zinc). Regarding polymers, plastics typically have a CTE in the range of about $10\times10^{-6}$ in./in./° C. to about $200\times10^{-6}$ in./in./° C. By combining a polymer material, such as a plastic, and a metallic material in the bi-material springs, a wide range of coefficients of thermal expansion can be provided in the springs. In embodiments, one material of the bi-material spring can have a CTE equal to, or similar to, that of the material forming the body of the blade, so as to provide matching to temperature variations in the blade load.

In embodiments, one strip can be composed of a material having a very low CTE such that it essentially does not expand when subjected to increases in temperature, and another material having a high CTE, which in combination with the other material causes deflection in the bi-material spring. The strips are typically joined together along their lengths. The different amounts of expansion of the two materials force the bi-material spring 916 to bend in one direction when exposed to an increase in temperature, and in the opposite direction when cooled below a reference temperature.

At its reference temperature, the bi-material spring is straight. In an exemplary embodiment, assuming that the bi-material spring has a reference temperature of 70° F., then at temperatures above 70° F., the bi-material spring will curve towards a surface. At temperatures below 70° F., the bi-material spring will curve away from the surface. When the reference temperature is lower than any operating temperature of the printing apparatus, then the bi-material spring will always be curved toward the surface. When the reference temperature is higher than any operating temperature of the printing apparatus, then the bi-material spring will always be curved away from the surface.

FIG. 9 shows the tip 914 of the blade 900 in contact with a surface 922 of a component. The surface 922 can be planar, as shown, or curved. The surface 922 can be moved relative to the fixed blade 900. In other cases, the blade 900 can be moved relative to a fixed surface. In a xerographic apparatus, for example, the blade 900 can be used for different functions depending on the type of component that the blade is operatively associated with. For example, the blade 900 can be used to remove a substance from a surface (i.e., for cleaning), or for controlling the thickness of a substance on a surface (i.e., for metering). When the blade 900 is used to clean the surface 922, the tip 914 of the blade 900 is arranged to contact the surface 922, as shown. For example, when the surface 922 is the outer surface of a rotatable photoreceptor roll, the substance can be a dry developer material (e.g., toner), and the tip 914 of the blade 900 can contact the surface 922 to remove residual toner.

As another example, when the component is a fuser roll, the blade 900 can be used to meter liquids, such as oils, or to remove dry toner, on an outer surface of the fuser roll. In metering applications, the force applied to the tip 914 of the blade 900 is less than the force needed for cleaning, which allows liquid to pass under the blade. Liquid is metered to the desired level by maintaining a pre-determined blade load.

During use of the blade 900, as the environmental temperature at the blade changes (i.e., the ambient temperature and/or the component temperature changes), the bi-material spring 916 deflects to increase or decrease the load on the blade 900, depending on the temperature change. The bi-material spring 916 applies a load to the free end of the blade including the tip 914, to affect the amount of force exerted by the tip 914 to the surface 922.

In embodiments, the materials forming the bi-material spring 916 and the dimensions of these materials can be chosen to produce changes in the force applied to the blade 900 that are close to, or matching, the cleaning stress and environmental conditions of the printing apparatus. In other words, the applied load by the blade 900 is close to, or equal to, the cleaning load. As the environmental temperature at the location of the blade 900 changes, the bi-material spring 916 modifies the applied load of the blade 900 to be close to, or equal to, the cleaning load. Use of the bi-material spring 916 can reduce, and desirably can minimize, over-loading of the blade 900 at any temperature it encounters, so as to increase blade life as compared to blades without temperature compensation features. By applying a load with the blade 900 that is only about as large as the cleaning load under different temperature and stress conditions, wear of the component cleaned by the blade 900 can also be decreased. For example, photoreceptor roll or belt life can be increased due to decreased wear by the blade.

In embodiments, shorter bi-material spring-loaded blades are desirable for use in a cantilever configuration. Equation (5) disclosed herein illustrates trade-offs that can be made between length, specific deflection value, thickness and temperature range. Larger specific deflection values allow the use of shorter blades. Shorter cantilever-spring-loaded blades can be used in environments, such as in xerographic apparatuses, where space is limited. Bi-material springs made of materials with higher specific deflection values allow shorter cantilever-spring-loaded blades to be used. In embodiments, the extension of the bi-material spring from the blade holder can be varied to provide additional flexibility in choosing the bi-material spring thickness.

In some embodiments, the blade is constructed such that the bi-material spring applies a force to the blade in addition to a force load applied to the blade by another load source. FIG. 10 depicts a force-loaded blade 1000 according to such embodiment. The blade 1000 includes a body 1002 made of an elastomeric material. The body 1002 includes a first surface 1008, an opposite second surface 1010 and a free end portion with a tip 1014. The body 1002 is attached to a rigid blade holder 1004. The blade holder 1004 is pivotally connected to a fixed support 1024 about an axis 1026.

The blade 1000 further includes a bi-material spring 1016 including a free end 1018 pressing against the second surface 1010 at the free end portion of the body 1002, and a fixed end 1020 secured to a fixed support (not shown) or to the rigid blade holder 1004. In the embodiment, an additional force applying member applies a force represented by arrow F to the blade holder 1004. The force-applying member can be a spring, or the like, positioned to apply the force F at a selected location along the length of the blade 1000. The tip 1014 of the blade 1000 is in contact with a surface 1022 of a component.

FIG. 11 depicts a force-loaded blade 1100 according to another exemplary embodiment. The illustrated blade 1100 has the same construction as the blade 1000 shown in FIG. 10 except for the location and configuration of bi-material spring 1116 as compared to bi-material spring 1016. The blade 1100 includes a body 1102 made of an elastomeric material, attached to a rigid blade holder 1104. The body 1102 includes a first surface 1108, an opposite second surface 1110 and a free end portion having a tip 1114. The blade holder 1104 is pivotally connected to a fixed support 1124 about an axis 1126.

The blade 1100 further includes a bi-material spring 1116 including a fixed end 1120 secured to the fixed support 1124, and also a free end 1118 in contact with the blade holder 1104. In the embodiment, a force applying member applies a force represented by arrow F to the blade holder 1104. The force-applying member can be a spring, or the like. The tip 1114 of the blade 1100 is in contact with a surface 1122 of a component.

Figure 12:
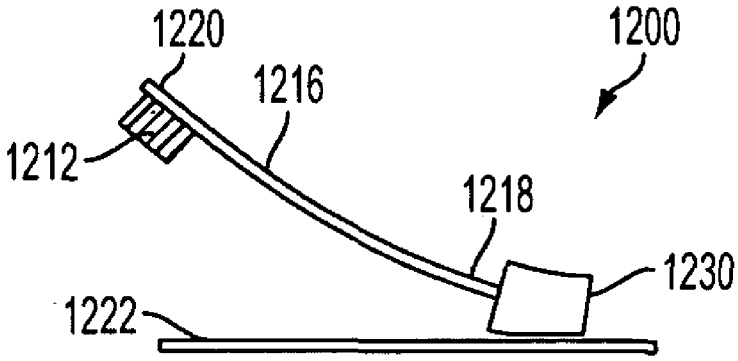
FIG. 12 illustrates another exemplary embodiment of an interference-loaded blade including a bi-material spring, without an external force applied to the blade.
Figure 13:
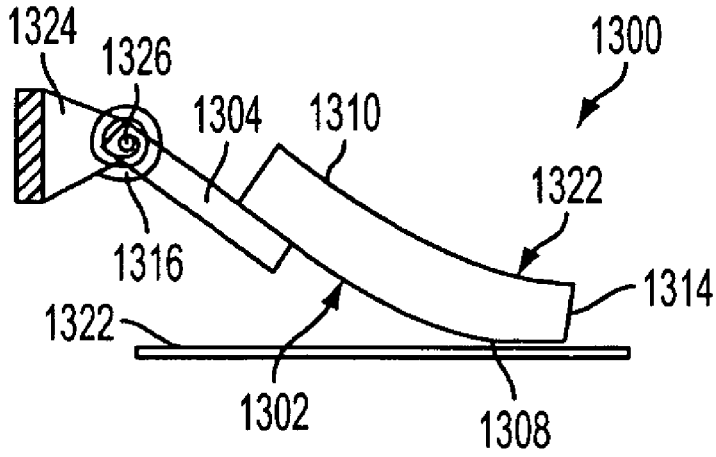
FIG. 13 illustrates another exemplary embodiment of a force-loaded blade including a bi-material torsion spring, without an external force applied to the blade.
Figure 14:
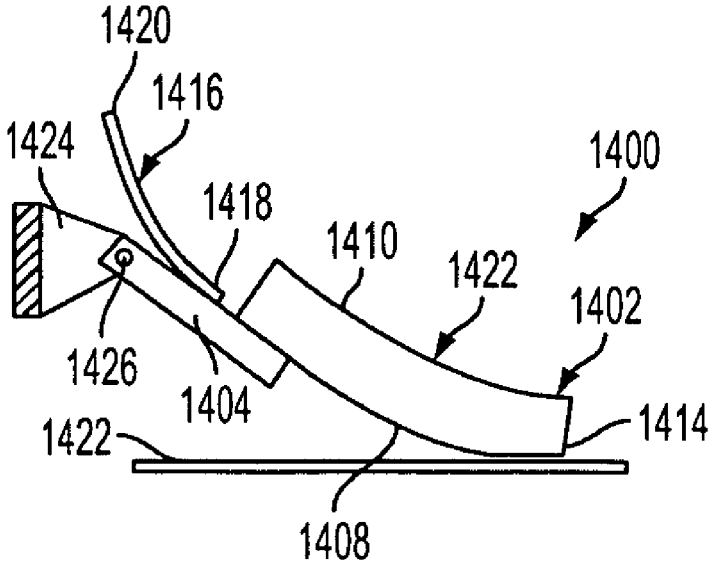
FIG. 14 illustrates another exemplary embodiment of a force-loaded blade including a bi-material spring, without an external force applied to the blade.

In some embodiments, the bi-material spring is the sole load source for the blade. Exemplary embodiments of such blades are shown in FIGS. 12 to 14. FIG. 12 depicts an interference-loaded blade 1200 according to an exemplary embodiment. The blade 1200 includes a bi-material spring 1216 including a fixed end 1220 secured to a fixed support 1212, and also a free end 1218. The blade 1200 comprises a body composed of an elastomeric material in the form of tip 1230 provided on the free end 1220. For example, the tip 1230 can be friction fit on, or adhesively bonded to, the free end 1218 of the bi-material spring 1216. The tip 1230 is shown in contact with a surface 1222 of a component. In embodiments, elastomeric blade-induced, applied load variations can be substantially eliminated by the structure of the blade 1200 such that the bi-material spring 1216 only compensates for changes in the cleaning load.

FIG. 13 depicts a force-loaded blade 1300 according to another exemplary embodiment. The blade 1300 has the same construction as the blade 1000 shown in FIG. 10 except for the type and location of the bi-material spring 1316 of the blade 1300 as compared to the bi-material spring 1016. The blade 1300 includes a body 1302 made of an elastomeric material attached to a rigid blade holder 1304. The body 1302 includes a first surface 1308, an opposite second surface 1310 and a free end portion having a tip 1314. The body 1302 is pivotally connected to a fixed support 1324 about an axis 1326.

The blade 1300 further includes a bi-material torsion spring 1316 located on the axis 1326. The tip 1314 of the blade 1300 is in contact with a surface 1322 of a component. The bi-material torsion spring 1316 applies a moment to the blade holder 1304 and presses the tip 1314 onto the surface 1322. The bi-material torsion spring 1316 can be used in blade applications where space is limited, or where bi-material leaf springs with sufficiently-high specific deflection properties may not be available.

FIG. 14 depicts a force-loaded blade 1400 according to another exemplary embodiment. The blade 1400 has the same construction as the blade 1300 shown in FIG. 13 except for the type and location of the bi-material spring 1416 of the blade 1400. The blade 1400 includes a body 1402 made of an elastomeric material attached to a rigid blade holder 1404. The body 1402 includes a first surface 1408, an opposite second surface 1410, and a free end portion having a tip 1414 in contact with a surface 1422 of a component. The body 1402 is pivotally connected to a fixed support 1424 about an axis 1426.

The blade 1400 further includes a leaf-type bi-material spring 1416 including a free end 1418 pressing against the rigid blade holder 1404, and also a fixed end 1420, secured to a fixed support, e.g., the fixed support 1424.

Embodiments of the blades 900, 1000, 1100, 1200, 1300 and 1400 shown in FIGS. 9 to 14, respectively, can be used in environments in apparatuses in which the cleaning stress is at a hot zone, cold zone, or in which no zone has a cleaning stress. For example, in an environment in which the cleaning stress is at a hot zone, any one of the blades 900, 1000, 1100, 1200, 1300 or 1400 can be used to compensate for blade load variation with temperature.

In an environment in which the cleaning stress is at a cold zone, applied loads may not significantly exceed cleaning loads. When compensation for variations in blade load due to temperature changes is desirable, then any one the blades 900, 1000, 1100, 1200, 1300 or 1400 can be used in the environment. Use of one of the blades 1000, 1100, 1300 and 1400, and especially the blade 1200, can substantially eliminate elastomeric blade-induced blade load variations so that only changes in the cleaning load need to be compensated for.

Lastly, in an environment in which there is no cleaning stress zone, a bi-material spring-assisted blade can be used to apply an additional force to the blade to compensate for the loss of blade load at higher temperatures. For example, any one of the blades 900, 1000, 1100, 1200, 1300 or 1400 can be used in the environment. This allows the cold temperature blade loads to be reduced, resulting in lower blade wear and longer blade life.

Embodiments of the blades 900, 1000, 1100, 1200, 1300 and 1400 shown in FIGS. 9 to 14, respectively, can be used in the apparatuses 100, 200, 300 and 400, shown in FIGS. 1 to 4, respectively. In the apparatus 100, the blade 132 can be replaced by one of the blades 900, 1000, 1100, 1200, 1300 and 1400. The blades 900, 1000, 1100, 1200, 1300 and 1400 can also be used in the apparatus 100 to, e.g., meter developer material 116 on the developer roll 114, to clean the intermediate transfer belt 118 following transfer of toner images to media, and/or to clean the conveyor belt 128.

In the apparatus 200, the cleaning member 222 can be replaced by one of the blades 900, 1000, 1100, 1200, 1300 and 1400. The blades 900, 1000, 1100, 1200, 1300 and 1400 can also be used in the apparatus 200, e.g., at cleaning stations E of the imaging stations 202, 204, 206 and 208 to clean developer material from the photoreceptor drums 210, to clean the intermediate transfer belt 212, and/or to clean the transfuse belt 218.

In the apparatus 300, the cleaning blades 310, 312 can be replaced by one of the blades 900, 1000, 1100, 1200, 1300 and 1400. The blades 900, 1000, 1100, 1200, 1300 and 1400 can also be used in the apparatus 300 to, e.g., clean the photoreceptor belt 302 following transfer of the toner image to the medium 308.

In the apparatus 400, the metering blades 412 and 430 can be replaced by one of the blades 900, 1000, 1100, 1200, 1300 and 1400.

Figure 17:
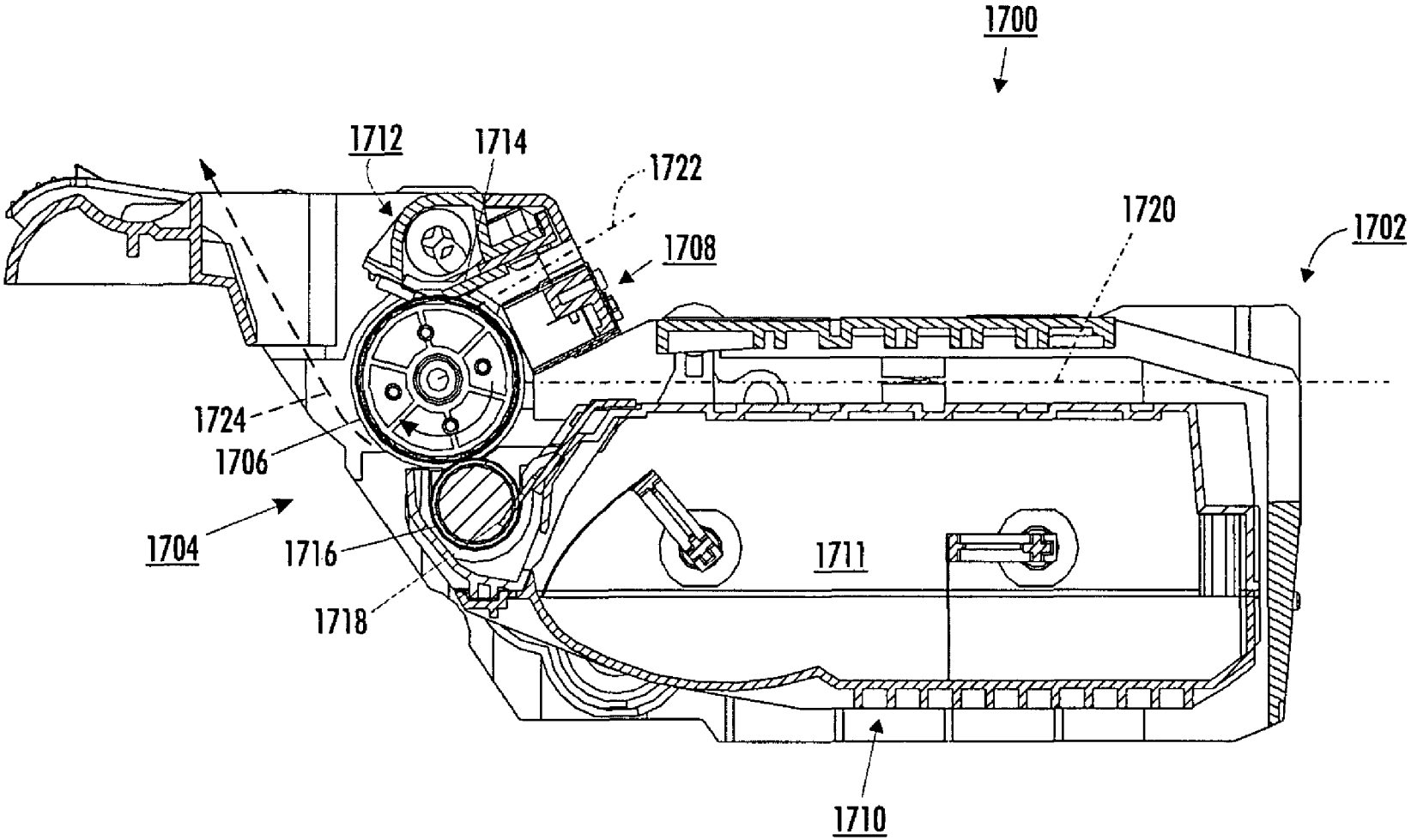
FIG. 17 is a vertical cross-sectional view of an exemplary embodiment of a replaceable cartridge for a printing apparatus.

Embodiments of the blades including a bi-material spring can also be used in compact xerographic apparatuses. FIG. 17 depicts an embodiment of a replaceable cartridge 1700, such as disclosed in U.S. Pat. No. 5,826,132, which is incorporated herein by reference in its entirety. The replaceable cartridge 1700 can be used in a compact xerographic apparatus. The replaceable cartridge 1700 is replaced when toner contained inside the cartridge has been consumed. The replaceable cartridge 1700 includes a housing subassembly 1702, a photoreceptor subassembly 1704 including a photoreceptor 1706, a charging subassembly 1708, a developer subassembly 1710 having a chamber 1711 containing a source of fresh developer material with toner, a cleaning subassembly 1712 having a cleaning blade 1714 for removing residual toner as waste toner from the outer surface of the photoreceptor 1706, and a waste toner sump subassembly for storing waste toner. The housing subassembly 1702 includes supporting, locating and aligning structures, as well as driving components for the replaceable cartridge 1700. The replaceable cartridge 1700 further includes a magnetic developer roller 1716 and a metering blade 1718. A light path 1720 for exposure light and a light path 1722 for erasing light are also shown.

Figure 18:
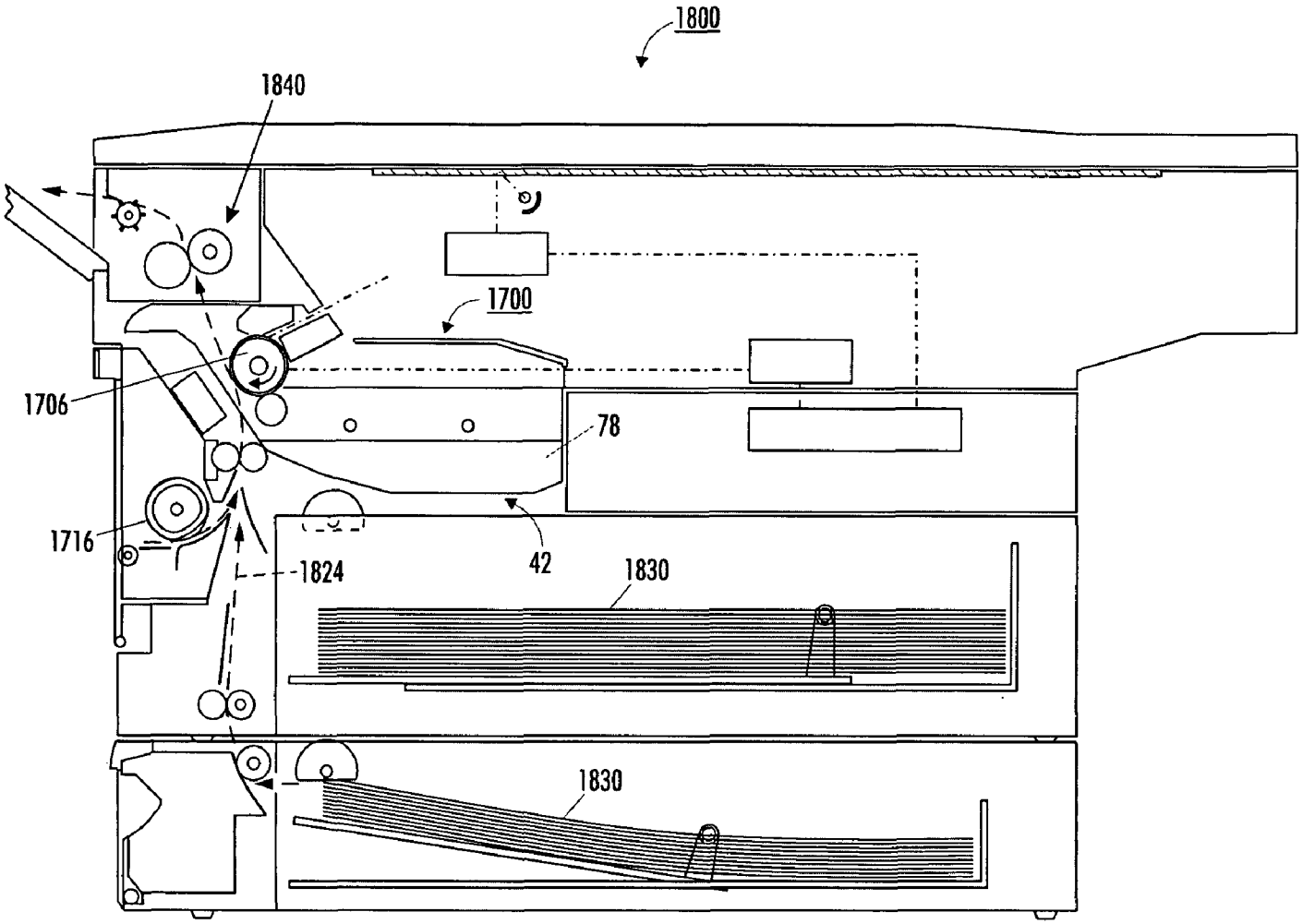
FIG. 18 illustrates an embodiment of a compact printing apparatus including the replaceable cartridge of FIG. 17.

FIG. 18 depicts an embodiment of a portable xerographic apparatus including an embodiment of the replaceable cartridge 1700, such as disclosed in U.S. Pat. No. 5,826,132, which is incorporated herein by reference in its entirety. As shown, media 1830 are stacked adjacent a media path 1824. During operation of the xerographic apparatus 1800, an imaging cycle includes charging the photoreceptor 1706 using the charging subassembly 1708. The charged portion of the photoreceptor 1706 is then exposed to light to form a latent image on the photoreceptor 1706. The portion of the photoreceptor 1706 bearing a latent image is then rotated to the developer subassembly 1710 where the latent image is developed with developer material. The developed image on the photoreceptor 1706 is then rotated and the toner image is transferred to a medium moving along a media path 1724. The medium having the transferred toner image is directed to a fuser 1840 to fix the toner image onto the medium. The medium is then transferred to a tray.

In the replaceable cartridge 1700, the cleaning blade 1714 and the metering blade 1718 can be replaced by one of the blades 900,1000,1100, 1200,1300 and 1400.

Embodiments of the blades including bi-material springs, such as blades 900, 1000, 1100, 1200, 1300 and 1400, can extend the life of components of apparatuses that are treated with the blades, due to reduced wear of such components by the blades. Embodiments of the blades including bi-material springs can also reduce blade load tolerances due to temperature compensation, and provide improved cleaning latitude. Embodiments of the blades including bi-material springs can also provide accurate temperature compensation by being located adjacent to portions of the blade, or forming the blade, rather than the printing apparatus using remote temperature sensing, such as general room environment, machine internal temperature or xerographic cavity temperature sensing.

EXAMPLE

A cleaning blade including a bi-material spring in the form of a leaf spring for temperature compensation is modeled. In the example, the cleaning stress is at a hot zone, where there is conflict between increasing cleaning load and decreasing applied blade load with increasing temperature.

Figure 15A:
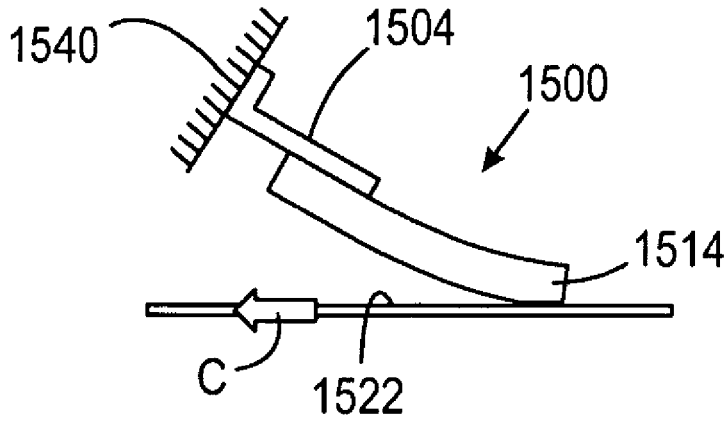
FIG. 15A illustrates an interference-loaded blade deflected by a surface.

FIG. 15A depicts an interference-loaded blade 1500. As shown, the blade 1500 is attached to a support 1504, which is fixedly secured to a machine frame 1540. The blade 1500 includes a tip 1514 in contact with a flat cleaning surface 1522. The blade 1500 is shown in the doctor orientation with the cleaning surface 1522 moving to the left, as indicated by the arrow C.

The bi-material spring is curved when not at the reference temperature of the spring material. Because the radius of the curved bi-material spring is much greater than eight times its thickness, the deflection of the bi-material spring is calculated using equations for the deflection of straight beams.

Figure 15B:
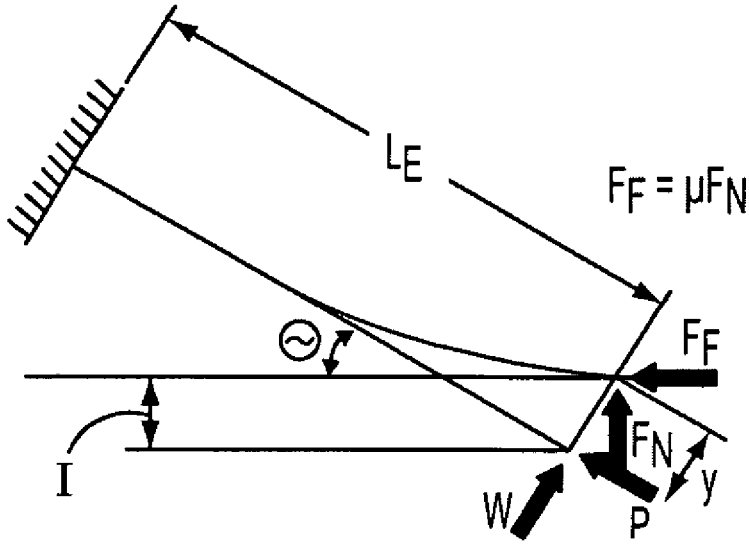
FIG. 15B illustrates parameters for calculating the deflection of the interference-loaded blade shown in FIG. 15A.

FIG. 15B shows parameters that are used to calculate the blade load for the interference-loaded blade shown in FIG. 15A. As shown in FIG. 15B, the blade holder angle, θ, is the angle that the un-deflected blade makes with the tangent plane to the flat cleaning surface at the point of contact. (For a cylindrical cleaning surface, the flat plane would represent the tangent at the point of contact to the cylindrical surface.) The blade interference, I, is the distance that the un-deflected blade would extend below the cleaning surface. Interference, I, is measured perpendicularly to the surface (or radially with respect to a cylindrical surface). The length of the blade, $L_E$, is the extension of the (un-deflected) blade beyond the end of the blade holder. The blade is assumed to be a cantilever beam.

As shown in FIG. 15B, the moving cleaning surface applies two forces to the tip of the blade. These forces are the normal force, $F_N$, which acts normal to the plane of the cleaning surface, and the friction force, $F_F$, which acts along the plane of the cleaning surface. The friction force is equal to the product of the coefficient of friction, μ, between the blade and the cleaning surface and the normal force, i.e., $F_F=\mu F_N$. FIG. 15B shows forces P and W, acting axially and transversely, respectively, to the un-deflected blade. The forces P and W are resolved from the friction force, $F_F$, and the normal force, $F_N$, through the blade holder angle θ with respect to the cleaning surface:

$$P=F_N \sin\theta+F_F \cos\theta=F_N(\sin\theta+\mu\cos\theta) \quad (1$$

$$W=F_N \cos\theta-F_F \sin\theta=F_N(\cos\theta-\mu\sin\theta) \quad (2)$$

In FIG. 15B, the distance, y, is the deflection of the blade. This deflection is calculated using equation (3). This equation is for a cantilever beam with an end load including the axial and transverse force components, P and W, respectively:

$$y=-W/kP(\tan kL_E-kL_E), \quad (3)$$

where k is given by:

$$k=(P/EI)^{1/2} \quad (b\ 4)$$

where E is the elastic modulus and I is the moment of inertia of the blade. Equations (3) and (4) are found in Warren C. Young, "Roark's Formulas for Stress and Strain," sixth ed. (1989).

These cantilever beam equations are applicable to elastomeric blades, or to bi-material springs used to apply loads to cleaning blades. For the blade 1200 shown in FIG. 12, the equations only for the bi-material spring are used because the elastomeric tip has a negligible contribution to loading of the blade tip. For the blade 900 shown in FIG. 9, the equations for both the bi-material spring and the elastomeric blade are used because both the bi-material spring and the elastomeric blade contribute to the loading of the blade tip. For the blades 1000,

1100, 1200, 1300 and 1400, the equations for the bi-material spring only are used because deflection of the elastomeric blade does not contribute to the blade tip loading.

Bi-material spring deflection, $y_c$, due to curvature of the bi-material spring as a result of a temperature change is added to, or subtracted from, the beam deflection, y, depending on the direction of the curvature with respect to the cleaning surface. When the bi-material spring curves towards the cleaning surface, $y_c$ is added to the total beam deflection, and when the bi-material spring curves away from the cleaning surface, $y_c$ is subtracted from the total beam deflection. The direction of the curvature depends on the reference temperature of the bi-material spring. The curvature, $y_c$, is determined as follows:

$$y_c=(a\cdot L_E^2/t)\,\Delta T \tag{5}$$

where a is the specific deflection and t is the thickness of the bi-material spring, and AT is the temperature change. Equation (5) is found at hoodandco.com, the website of HOOD & Co., located in Hamburg, Pa.

For the cleaning blade, the following cleaning load/temperature conditions are assumed: 27 g/cm at 60° F., 30 g/cm at 70° F., and 33 g/cm at 80° F.

Figure 16:
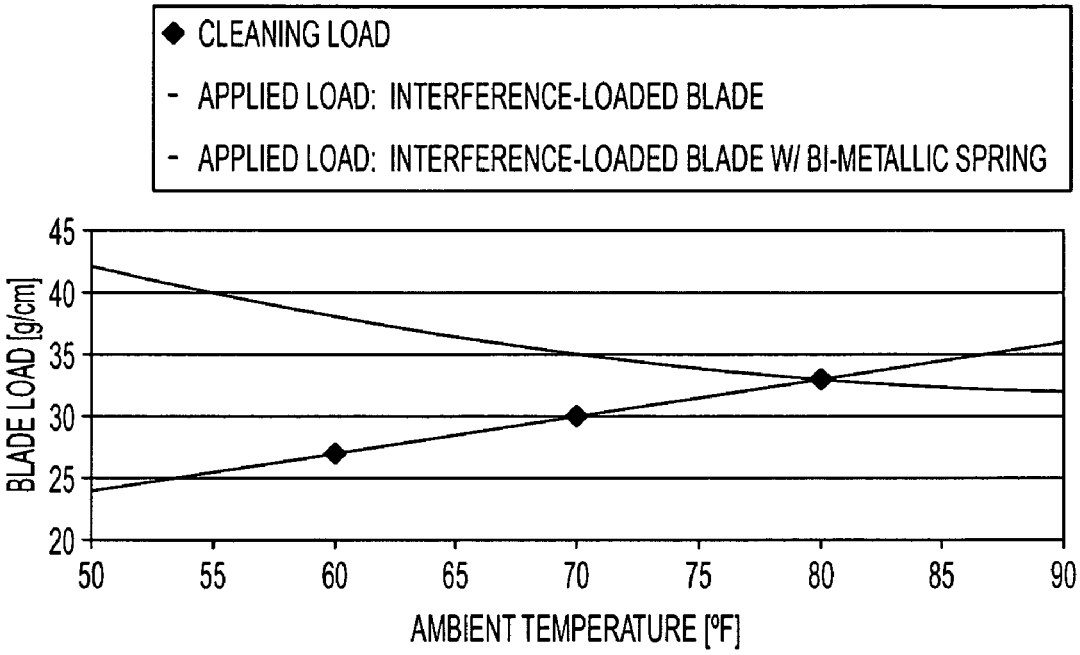
FIG. 16 illustrates an applied blade load versus ambient temperature curve for an interference-loaded blade without temperature-compensating features, and for an interference-loaded blade including a bi-material spring, where the stress cleaning load occurs at a hot zone in an apparatus.

FIG. 16 shows applied load versus ambient temperature curves for the interference-loaded blade shown in FIG. 15A without temperature compensation (see FIG. 8), and for an interference-loaded blade including an elastic blade and a bi-metallic spring, such as shown in FIG. 9. The sum of the bi-material spring load and elastomeric blade load provides a combined blade load.

The bi-metallic spring is composed of ASTM B388 Type TM2 material. This material includes a first metal composed, by weight, of 36% nickel and 64% iron, which is bonded to a second metal composed, by weight, of 72% manganese, 18% copper and 10% nickel. The first metal has a very low CTE, while the second metal has a high CTE. The bi-metallic spring has the following properties: elastic modulus (E): $20\times10^6$ psi ($1.38\times10^5$ MPa); and DIN 1715 specific deflection (a): 20.1 mm/mm/° C.$\times10^{-6}$.

For the bi-metallic spring, a 10 mm cantilever beam length (i.e., $L_E$=10 mm), a blade holder angle θ of 20°, and a bi-metallic strip thickness, t, of 0.0034 in. are assumed. A coefficient of friction, μ, of 1 between the blade and the cleaning surface is assumed.

As shown in FIG. 16, the interference-loaded cleaning blade without temperature compensation meets the highest cleaning load, which is at 80° F., and exceeds the cleaning load at the lower temperatures of 70° F. and 60° F. As shown, the applied blade loads are 38 g/cm at 60° F., 35 g/cm at 70° F., and 33 g/cm at 80° F. The excess blade load (i.e., cleaning load minus applied load) are 11 g/cm at 60° F., 5 g/cm at 70° F., and zero at 80° F.

As also shown in FIG. 16, the blade including a bi-metallic spring having the selected blade thickness is calculated to achieve the cleaning load for cleaning at all three temperatures of 60° F., 70° F. and 80° F., as shown in FIG. 16, i.e., the excess load is zero.

For embodiments including a force-loaded cleaning blade, a leaf-type bi-material spring similar to the bi-material spring used in the Example can be used.

In other embodiments of the force-loaded cleaning blades, a bi-material, e.g., bi-metallic, torsion spring can be used. For such torsion springs (for SI units), the following equations (6) (unrestrained thermal deflection), (7) (mechanical stiffness) and (8) (force developed by restraint or deflection) can be applied:

$$\alpha=(360aL\Delta T)/\pi t \tag{6}$$

where α is the rotation, L is spring length (mm), ΔT is the temperature change (° C.), and t is the spring thickness (mm).

$$F=(\pi E\alpha bt^3)/2160Lr \tag{7}$$

where F is the spring force (N), E is the elastic modulus of the spring (MPa), b is the width of the spring (mm), and r is the spring radius (mm).

$$F=(aEbT^2\Delta T)/6r \tag{8}$$

Equations (6) to (8) are found at the hoodandco.com website.

It will be appreciated that various ones of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, which are also intended to be encompassed by the following claims.

What is claimed is:

1. A blade for treating a substance on a surface of a component, comprising:

a body comprising a free end portion including a first surface, the body being comprised of an elastomeric material, an end opposite to the free end portion and pivotally mounted to a support, and a second surface opposite to the first surface; and a bi-material spring adapted to apply a load to the body such that the first surface of the body treats the substance on the surface of the component, wherein the bi-material spring includes a free first end applying a force to the second surface of the body at the free end portion and a fixed second end opposite to the first end.

2. The blade of claim 1, further comprising a force applying member for applying a force to the second surface of the body.

3. The blade of claim 1, wherein the bi-material spring includes an opposite free second end contacting the first surface of the body.

4. The blade of claim 3, further comprising a force applying member for applying a force to the second surface of the body.

5. The blade of claim 1, wherein the body is provided only on the free end of the bi-material spring.

6. The blade of claim 1, wherein:

the body is pivotally mounted to a support about an axis; and the bi-material spring is a torsional spring located about the axis.

7. A printing apparatus, comprising:

a blade according to claim 1;

wherein the component is selected from the group consisting of a photoreceptor roll, a photoreceptor belt, an intermediate transfer belt, a bias transfer belt, a bias transfer roll, an electrostatic detoning roll and a bias charging roll.

8. An ink jet printing apparatus, comprising:

a blade according to claim 1;

wherein the component is a roll or a belt.

9. An interference-loaded blade for cleaning a surface of a component in a printing apparatus, the blade comprising:

a bi-material spring including a fixed first end and a free second end opposite to the first end; and a body having a free end portion including a first surface and secured to the bi-material spring, the body comprised of an elastomeric material, an end opposite to the free end portion and pivotally mounted to a support, and a second surface opposite to a first surface;

wherein the bi-material spring is adapted to apply a load to the body such that the body contacts and cleans the surface of the component, and the bi-material spring applies a force to the second surface of the body.

10. The blade of claim 9, wherein the blade extends from the support in a cantilever configuration.

11. The blade of claim 9, wherein the blade extends from the support in a cantilever configuration.

12. A printing apparatus, comprising:

an interference-loaded blade according to claim 9;

wherein the component is selected from the group consisting of a photoreceptor roll, a photoreceptor belt, an intermediate transfer belt, a bias transfer belt, a bias transfer roll, an electrostatic detoning roll and a bias charging roll.

13. An ink jet printing apparatus, comprising:

an interference-loaded blade according to claim 9;

wherein the component is a roll or a belt.

14. A replaceable cartridge for a printing apparatus, comprising:

a chamber for containing developer material including toner;

a photoreceptor having a surface on which toner images are formed; and a blade for cleaning toner on the surface of the photoreceptor comprising:

a body comprising a free end portion including a first surface, the body being comprised of an elastomeric material, an end opposite to the free end portion and pivotally mounted to a support, and a second surface opposite to the first surface; and a bi-material spring adapted to apply a load to the body such that the first surface of the body cleans the toner on the surface of the photoreceptor, wherein the bi-material spring includes a free first end applying a force to the second surface of the body at the free end portion and a fixed second end opposite to the first end.

15. A printing apparatus comprising a replaceable cartridge according to claim 14.

16. A method of treating a substance on a surface of a component in a printing apparatus with a blade comprising a body comprised of an elastomeric material, and a bi-material spring, the method comprising:

applying a load to the body with the bi-material spring, wherein the body includes an end opposite to the free end portion and pivotally mounted to a support, and a second surface opposite to the first surface, and the bi-material spring includes a free first end applying a force to the second surface of the body at the free end portion and a fixed second end opposite to the first end; and contacting the substance on the surface of the component with the body.

17. The method of claim 16, wherein:

the printing apparatus is a xerographic apparatus;

the substance is a dry developer material;

the component is a roll or a belt; and the contacting comprises cleaning the substance from the surface of the component.

18. The method of claim 16, wherein:

the printing apparatus is a xerographic apparatus;

the substance is a liquid;

the component is a roll or a belt; and the contacting comprises metering the substance on the surface of the component.

19. The method of claim 16, wherein:

the printing apparatus is an ink jet printing apparatus;

the substance is a liquid;

the component is a roll or a belt; and the contacting comprises metering the substance on the surface of the component.

* * * * *